United States Patent [19]

Hanke

[11] 4,329,394

[45] May 11, 1982

[54] SURFACE-COATED, UNSIZE-PRESSED CELLULOSIC SHEET AND METHOD FOR MAKING SAME

[75] Inventor: David E. Hanke, Washougal, Wash.

[73] Assignee: Crown Zellerbach Corporation, San Francisco, Calif.

[21] Appl. No.: 185,477

[22] Filed: Sep. 9, 1980

[51] Int. Cl.[3] ..... B32B 7/00

[52] U.S. Cl. ..... 428/342; 428/213; 428/219; 428/498; 428/513; 428/537; 162/142

[58] Field of Search ..... 428/342, 213, 219, 498, 428/513, 537; 162/142

[56] References Cited

U.S. PATENT DOCUMENTS

| | | | |
|---|---|---|---|
| 3,017,295 | 1/1962 | Outterson et al. | 428/342 |
| 3,661,697 | 5/1972 | Kimmel et al. | 428/342 |
| 4,152,197 | 5/1979 | Lindahl et al. | 162/142 |

*Primary Examiner*—J. Travis Brown

*Attorney, Agent, or Firm*—Jerome S. Marger

[57] ABSTRACT

This invention provides a method for producing a novel, surface-coated, unsize-pressed cellulosic sheet, the cellulosic substrate thereof including at least 25% by weight of cedar fibers. The coating is maintained on or above the surface of the cellulosic substrate so that an optimum hold-out ratio of surface-coating-weight to surface-coating-thickness is maintained.

14 Claims, No Drawings

SURFACE-COATED, UNSIZE-PRESSED CELLULOSIC SHEET AND METHOD FOR MAKING SAME

BACKGROUND OF THE INVENTION

Cellulosic substrates having a surface coating thereon such as an adhesive-coated cellulosic paper are well-known to the prior art (see U.S. Pat. No. 3,055,496 to Dunlap, and U.S. Pat. No. 3,677,788 to Zirnite). Control of the depth of penetration of the coating material into the interstices of the cellulosic substrate is extremely important since penetration by excessive amounts of coating provides a product which is not economical to manufacture. Another problem which also occurs is strike-through, wherein the coating compound penetrates through the cellulosic substrate causing an unwanted layer of adhesive to be deposited on the coating equipment. This, in turn, results in more frequent equipment shutdown for cleaning purposes.

The ability to prevent excessive penetration of the coating material and to maintain a uniform, continuous, smooth coating surface is defined as "hold-out". The term "hold-out" also encompasses the notion that penetration of the coating composition to the base substrate must be minimized while maintaining efficient coating usage at reasonable coating weights.

In order to facilitate effective hold-out of the coating material, the prior art contemplates treatment of the surface of the cellulosic substrate in a size press with sizing agents such as starch and/or petroleum-based polymers such as styrenemaleic anhydride. Expensive wet-end chemicals are also employed to increase hold-out properties. However, the problem occurs in that many paper machines are not equipped with size presses since this equipment is quite costly to purchase and is often difficult to economically justify. Economic justification for this equipment is of particular difficulty in the case of older paper machines which exhibit more marginal economic benefit to a given manufacturer.

SUMMARY OF THE INVENTION

The subject invention is directed to surface-coated cellulosic substrates and to a method for making same. Even though these cellulosic substrates are produced without size pressing, they exhibit the requisite hold-out properties and minimize penetration of the coating material below the substrate surface so that efficient coating usage can be provided at reasonable coating weights. The cellulosic substrate, in order to facilitate hold-out without size pressing, includes at least 25% by weight of cedar fibers, and preferably at least about 35% by weight, and more particularly at least about 45% by weight.

The surface coating layer, i.e., the coating layer which is maintained at or above the cellulose substrate surface, is disposed in a uniform, continuous and smooth condition, at a thickness of at least about 0.65 mil, and preferably at least about 0.75 mil, and more preferably at least about 0.90 mil, and most preferably at least about 1.0 mil.

It is important that the coating thickness be maintained without employing high total coating weights of the coating composition since the coating material will penetrate into the interstices of the sheet, as previously described, and will ultimately foul the coating equipment. Therefore, it is provided that the optimum hold-out ratio of the surface coating weight, in pounds per 3,000 square feet, to the surface coating thickness in mils, is preferably from about 5:1, and more preferably from about 8:1, and most preferably from about 10:1, up to about 25:1, and more preferably up to about 20:1, and most preferably up to about 15:1.

Although cedar fibers have been employed to make mothproof papers such as described in U.S. Pat. No. 174,484 to Cobb; U.S. Pat. No. 194,986 to Brown; and U.S. Pat. No. 1,927,798 to Kinnell, respectively, the production of any coated paper composition employing the requisite amount of cedar fibers to provide the above described hold-out properties has not been described.

DETAILED DESCRIPTION OF THE INVENTION

In accordance with the present invention, a coated, unsize-pressed cellulosic sheet and method for making same are provided. The cellulosic substrate includes cellulosic papermaking fibers and cedar fibers, respectively. Cellulosic papermaking fibers employed herein include coniferous pulpwood such as spruce hemlock, fir, pine, and the like, as well as deciduous pulpwood such as oak, poplar, birch, cottonwood, alder, etc. Preferably, the cellulosic papermaking fibers will be predominantly coniferous pulpwood because those have a greater fiber length than their deciduous counterparts.

The other component forming the subject substrate is cedar fibers. At least about 25% by weight of the cedar fibers are employed in the formation of the cellulosic substrate. Any known cedar pulpwood such as red cedar and the like may be employed for this purpose.

The cellulosic substrate is then produced from a furnish of the above fibers and a parent cellulosic roll formed by conventional papermaking techniques.

The parent roll is then subjected to a coating step in which a smooth, uniform, continuous coating layer is applied to the substrate according to the previously described thickness, and coating weight-to-thickness levels, without substantial penetration of the coating material into the interstices of the substrate.

In an example, 17 pounds for 3,000 square feet of a water-based vegetable adhesive was transferred from a coating trough by a coating roll to an applicator roll. The adhesive had a Brookfield viscosity of 700 centipoises at 193° F. (Brookfield Model RVT, No. 2 Spindle, 30 rpm). The applicator roll and a coacting pressure roll formed a nip through which cellulosic substrates passed. Two unsize-pressed cellulosic substrates were then coated with the adhesive composition. The first substrate comprised cellulosic fibers and 13% cedar fibers, and the second substrate included the same cellulosic fiber components and 45% cedar fibers. The first coated substrate exhibited a substantially nonuniform, noncontinuous, nonsmooth surface and had a coating thickness of 0.6 mil. The second substrate had a uniform, continuous, smooth surface and a coating thickness of 1.0 mil.

The coating material is applied at a level of preferably from about 10 pounds, and more preferably from about 12 pounds, and most preferably from about 15 pounds, up to about 35 pounds, and more preferably up to about 30 pounds, and most preferably up to about 25 pounds for 3,000 square feet of unsize-pressed substrate.

The unsize-pressed cellulosic substrate of this invention can be coated with materials which are applied to cellulosic substrates which normally require size-pressing. These materials include adhesive compounds such as vegetable gums and the like, moisture barrier films such as polyvinylidene chloride, extrusion coatings such as polyolefins, and the like, etc.

I claim:

1. A uniform, continuous, smooth, surface-coated cellulosic substrate composition, which comprises (a) an unsize-pressed cellulosic substrate, having a substantial degree of coating hold-out, comprising cellulosic papermaking fibers and at least 25% by weight of cedar fibers; and (b) a coating composition, which is applied to said substrate, the ratio of the coating weight, in pounds per 3,000 square feet, to the coating thickness, in mils, is from about 5:1, up to about 25:1.

2. The substrate composition of claim 1, wherein the ratio is from about 8:1, up to about 20:1.

3. The substrate composition of claim 1, wherein the ratio is from about 10:1, up to about 15:1.

4. The substrate composition of claim 1, wherein the coating thickness is maintained from at least about 0.65 mil.

5. The substrate composition of claim 1, wherein the coating thickness is maintained from at least about 1.0 mil.

6. The composition of claim 1, which includes at least from about 35% by weight of cedar fibers.

7. The composition of claim 1, which includes at least from about 45% of cedar fibers.

8. A method for producing a uniform, continuous, smooth, coated cellulosic substrate composition, which comprises (a) forming an unsize-pressed cellulosic substrate, including at least about 25% by weight of cedar fibers; and (b) applying a uniform, continuous, smooth, surfacecoating layer to said substrate, the ratio of the weight of said coating, in pounds per 3,000 square feet of said substrate, to the thickness of said coating, in mils, is from about 5:1, up to about 25:1.

9. The method of claim 8, wherein said ratio is from about 8:1, up to about 20:1.

10. The method of claim 8, wherein said ratio is from about 10:1, up to about 15:1.

11. The method of claim 8, wherein said coating layer is maintained at a thickness of at least about 0.65 mil.

12. The method of claim 8, wherein said surface-coating layer is maintained at a thickness of at least about 1 mil.

13. The method of claim 8, wherein the amount of cedar fibers is maintained at about 35% by weight.

14. The method of claim 13, wherein the amount of cedar fibers is at least 45% by weight.

* * * * *